United States Patent [19]

Oiern et al.

[11] 4,004,535

[45] Jan. 25, 1977

[54] VESSEL COMPRISING A HULL FOR TRANSPORTING COOLED LIQUEFIELD GAS

[75] Inventors: Per Jorgen Oiern, Oslo; Knut Helge Osmundsvaag, Lierbyen, both of Norway

[73] Assignee: A/S Akers Mek. Verksted, Oslo, Norway

[22] Filed: June 12, 1975

[21] Appl. No.: 586,175

Related U.S. Application Data

[63] Continuation of Ser. No. 396,327, Sept. 11, 1973, abandoned.

[52] U.S. Cl. ..... 114/74 A; 220/9 LG

[51] Int. Cl.[2] ..... B63B 25/08

[58] Field of Search ..... 114/74; 220/9 A, 15, 220/9 LG; 62/55; 248/DIG. 1

[56] References Cited

UNITED STATES PATENTS

| | | | |
|---|---|---|---|
| 3,680,323 | 8/1972 | Bognaes et al. | 114/74 A X |
| 3,770,158 | 10/1971 | Alleavme | 220/9 LG |

*Primary Examiner*—Trygve M. Blix
*Assistant Examiner*—Sherman D. Basinger
*Attorney, Agent, or Firm*—Watson, Cole, Grindle & Watson

[57] ABSTRACT

A vessel having at least one container for the transportation of cooled, liquefied gas or the like, the vessel having at least one cargo hold located below the deck of the vessel, side tanks below the deck extending transversely outwardly of the cargo hold, and the transverse cross-sectional area of the cargo hold being slightly less than the maximum cross-sectional area of the container so that the container is supported by the cargo hold whereby the lower portion of the container extends only slightly downwardly within an open top portion of the cargo hold.

8 Claims, 4 Drawing Figures

VESSEL COMPRISING A HULL FOR TRANSPORTING COOLED LIQUEFIELD GAS

This is a continuation of application Ser. No. 396,327 filed Sept. 11, 1973, and now abandoned.

It is previously known to transport cryogenic or cooled gas in liquefied form (in the following called "liquefied gas") in special ships, so-called LNG ships where gases in liquefied form under approximately atmospheric pressure is transported in containers preferably made of aluminum or special steel in order to withstand thermal and other stresses without becoming brittle at the very low temperatures existing in transport of liquefied gases, e.g. methane, which liquefies at about + 162° C, ammonia at about + 33° C, hydrogen at about + 260° C etc.

The containers preferably have spherical, cylindrical, or prismatic form and are arranged in separate rooms in the longitudinal direction of the ship and generally with the container in its entirety below deck.

These known implementations have, among others, the disadvantage that the supporting of containers in an open or closed cargo room introduce large stresses in the bottom part of the hull which must be counteracted by substantial re-inforcements of these parts with accompanying additional building costs. Another drawback are the complicated insolation problems which are costly to solve, and, furthermore, the complicated and costly arrangements in the bottom part of the hull for collecting and removing of any gas leakage which, if it should contact parts of the ship hull of ordinary steel quality, would destroy these due to the low temperature of the gas. In addition, the unloading of the containers is complicated.

It is further known to arrange the containers on deck, completely separated from subjacent buoyancy compartments. U.S. Pat. No. 3,507,242 shows a design of this type where parallelepipedic, freestanding containers are arranged on deck in a row in the longitudinal direction of the ship.

The volume of the hull below deck is used only to give the necessary buoyancy and this design has, among others, the disadvantage that these rooms into which the hull is sub-divided for this reason must be empty during the transport. In addition, to maintain the necessary stability under all conditions is complicated, and the securing of the containers to the hull becomes extensive and costly.

Ships of this type also are known from U.S. Pat. No. 3,422,779 where cylindrical containers are arranged on deck in the longitudinal direction of the ship and parallel to each other over the entire width of the ship and separated from the hull below, said deck being arranged to have an elevation equal to or below the water surface during motion of the ship. This design has the same disadvantages as the ship in accordance with U.S. Pat. No. 3,507,242, especially the empty rooms, the stability conditions, the maintenance of necessary free board and, in addition, protection of the containers against waves during motion in heavy sea.

A further known embodiment is described in Norwegian Pat. No. 98,939 where the room between the hull and the tanks and connected piping and other equipment totally enclosed by the hull, instead of usual isolation and protective shell, is filled with oil which, after loading of liquefied gas, are cooled by means of cooling coils so that the oil practically becomes completely solid and forms the necessary isolation barrier between the container and the hull. The drawback with this design is that the solid oil before any unloading must be subjected to a costly heating process to gain the necessary fluidity for pumping, and the quality of the oil must be such that it takes the necessary solid form in cooled condition. Furthermore, the cleaning of the generally inaccessible areas where the oil has been stored will be so complicated that it is doubtfull that the ship will receive the necessary certificate for cleanliness with respect to gas and oil necessary for dry docking, repairs and similar situations.

A major disadvantage in the vessels mentioned above and hereto for other known vessels is the poor relation between the buoyancy of the vessel and its usable capacity.

E.g., the density of liquefied gas varies from about 0.425 to about 0.475 and, due to this low specific gravity, it is not possible to get enough room for the containers so that the buoyancy of the ship is utilized in a satisfactory way. The vessels are overdimensioned with an undesirable high free-board and consequent large width for stability reasons, even though the previously mentioned necessary and costly supports and reinforcements of the hull's bottom part represent substantial weight additions compared to conventional tankers of the same size.

The purpose of the invention is to eliminate these and other disadvantages and to obtain ship designs or types which combine transport of cargos of low specific gravity, e.g. liquefied gas, wooden ships or similar other cargo in such a way that the maximum permissible dead weight of the ship (loading ability or buoyancy) is utilized as completely as possible, and which will, e.g. by transportation of oil and liquefied gas in the same vessel obtain substantially higher earnings than a comparable oil tanker and a comparable liquefied gas tanker.

In accordance with a very important part of the invention, containers for transportation of e.g. liquefied gas are preferably arranged so that the container for the main part is situated above deck level while only a smaller part is situated below deck level. This arrangement of the containers is technically feasible and safe due to the very low specific gravity of the liquefied gas.

A further important aspect of the invention is to make available the below rooms, center tanks and side tanks, which rooms and adjacent side rooms can be used for simultaneous transport of e.g. oil in such quantities that the maximum permissible dead weight of the vessel is completely utilized.

A further important part of the invention is the supporting of the containers on the longitudinal and transverse bulkheads of the hull, preferably at deck level or a suitable height above the deck.

A further important part of the invention is the complete separation of container and subjacent hull structure so that said hull structure can be made from usual soft ship steel and without insolation and protection against gas leakage.

These and other important parts of the invention will be described more closely in the following with reference to the drawings:

FIGS. 1 and 2 schematically show a vessel in accordance with the invention seen from the side and from above, respectively.

Figure 1:
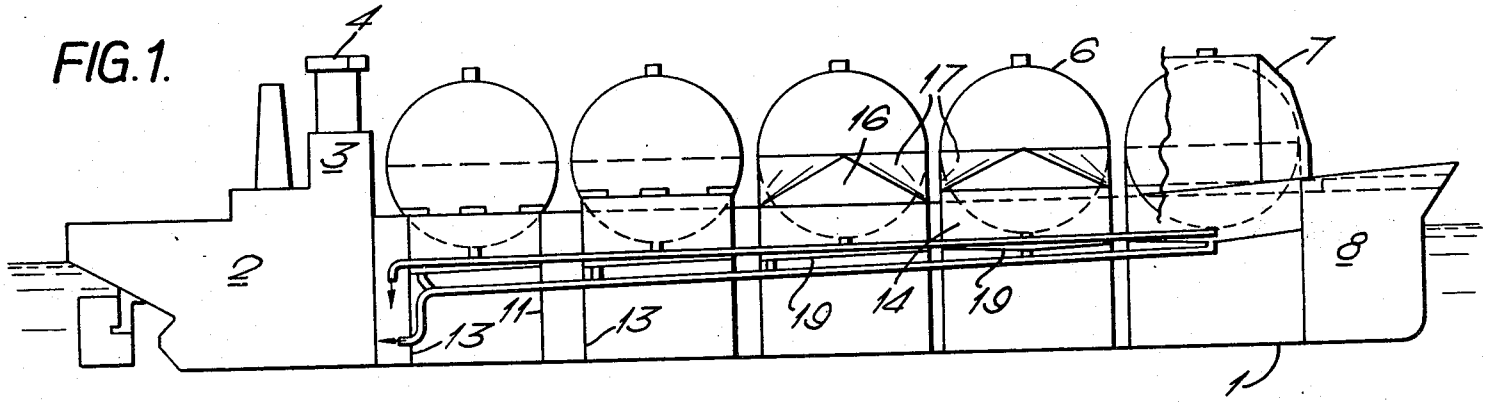

Referring to FIG. 1, a preferred embodiment of the new vessel generally comprises a hull 1, proportion plant 2, super-structure 3, and bow portion 8, arranged as shown.

The bridge 4 has a characteristic form and is elevated relatively high above the deck 5, thereby to give the necessary view above the containers 6 and the outside insolation shells 7, while the extension of the bridge to both sides of the vessel gives the necessary view along this side of the ship by means of the open part of the deck between the sides of the vessel and the shells 7. With the use of extremely large containers, the bridge 4 can preferably be arranged in a suitable place closer to the bow portion 8 of the ship.

The preferred embodiment shown with spherical containers 6 will be described more closely in the following, but it must be understood that this is only an example of an embodiment and that any form of the container, e.g. prismatic, cylindrical, or cubical can be used without departure from the scope and spirit of the invention.

Figure 2:
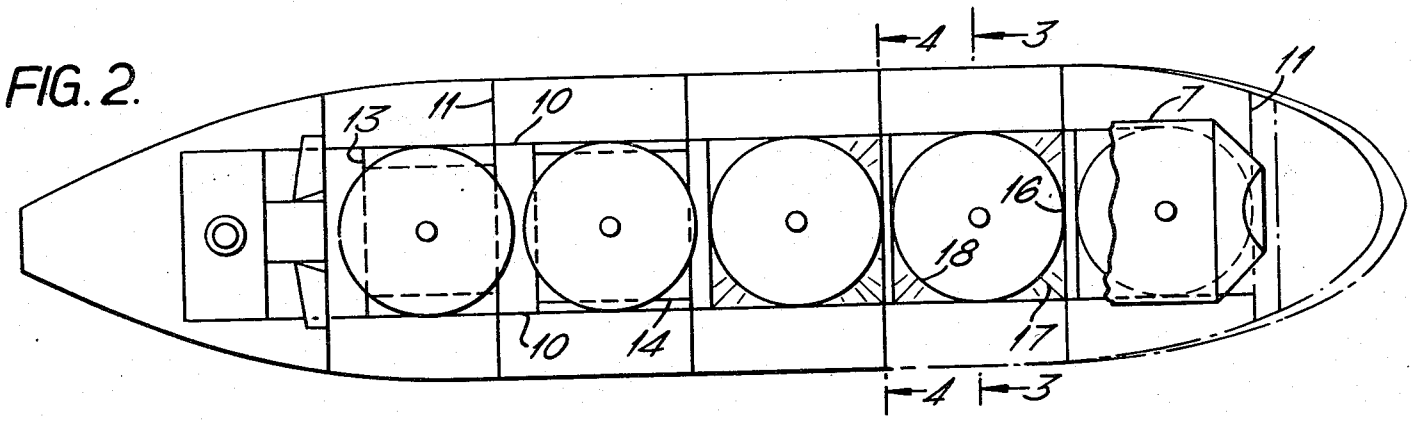
Figure 3:
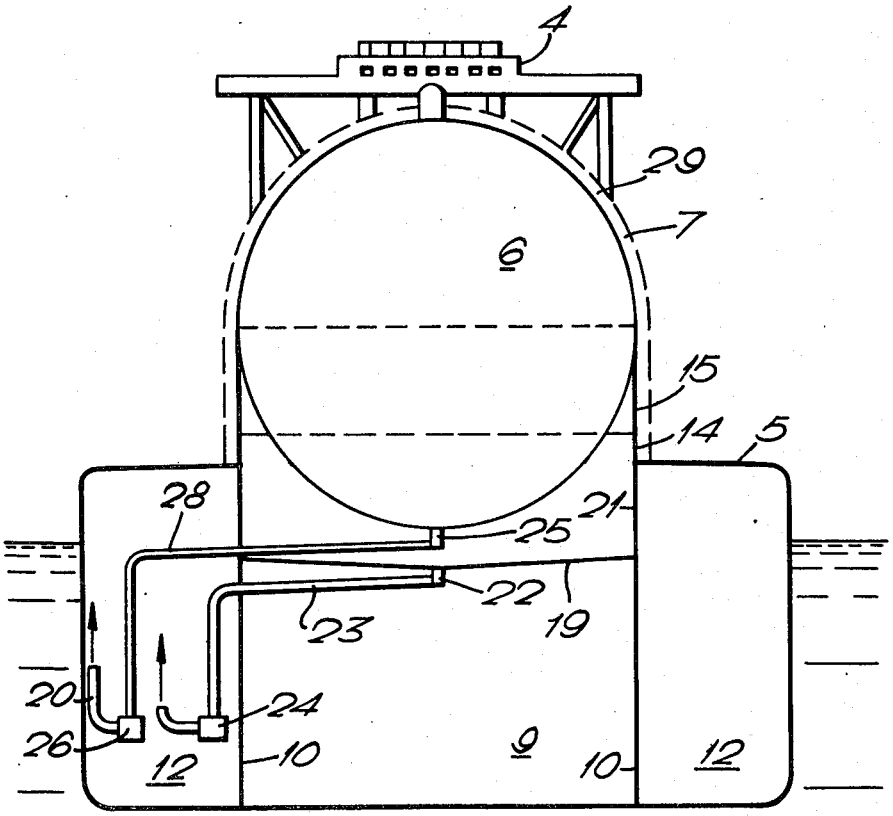
FIG. 3 is a cross-sectional view taken along the line 3—3 of FIG. 2.

As shown in FIGS. 1, 2 and 3, the ship is subdivided into rooms 9 by means of longitudinal bulkheads 10 and transverse bulkheads 11, and these rooms will in the following be referred to as center tanks. The length of the center tanks in the longitudinal direction and therewith in the transverse direction correspond approximately to the diameter of the spherical container 6 in the shown example. The transverse bulkhead 11 is extended out to the sides of the vessel where they form side tanks 12 on each side of the center tanks 9. Furthermore, inside the center tanks are preferably arranged extra transverse bulkheads 13 between the longitudinal bulkheads 10. In the example shown, five center tanks appear and four of these have the same dimensions corresponding approximately to the diameter of the spherical container 6.

In the center tanks 9, longitudinal bulkheads 10 and transverse bulkheads 11 and 13 are preferably extended through the deck 5 of the vessel to a suitable height above the deck thereby forming separated frames or walls which in the following will be referred to as frames 14. Such a frame is also formed when the bulkheads 10, 11 and 13 are not extended above the deck but are terminated and stiffly connected to the bottom side of the deck.

The frame 14 thereby forms a support for the container and, in the example shown in FIG. 3, it is rigidly connected to the frame. The connections are made by a so-called skirt 15, which consists of flat upwardly directed plates 16 which are welded to the four straight sides of the frame and by curved segments 17 which cover the openings formed thereby near the corners of the frame. The parts 16 and 17 together form a transition, namely the skirt 15, which goes from the rectangular form of the frame to the circular form of 18 of the container 6.

By the use of containers of another form, e.g. prismatic, the sides of the skirt 15 preferably become approximately straight and flat.

In accordance with the invention, the longitudinal length and the transverse width of the frame are approximately the same and correspond to the dimension of the container in such a way that the forces acting vertically can be transmitted in the best way to the subjacent hull structure.

In the preceeding example the frame 14 is in the form of a square where the length of these sides correspond to the diameter of the spheres 6 at the equator which in this example is the support line for this sphere.

Figure 4:
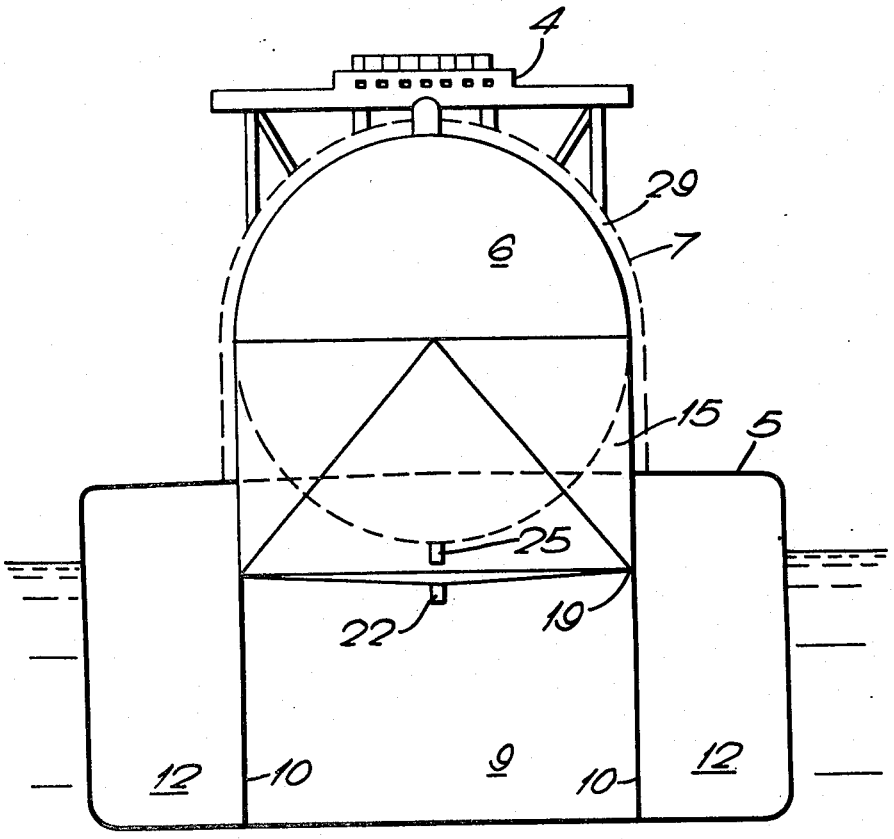
FIG. 4 shows a modified support for a liquefied gas container taken along the line 4—4 of FIG. 2.

The skirt 15 is in the present example, as shown in FIGS. 1 and 3, a fixed extension of the sides formed by the frame 14, and the extension extends from the level of the deck or the upper edge of the extended sides of the frame 14. In certain cases it can be advantageous that the skirt 15 extends from the bottom part 19 of the frame and thereby form the sides of the frame as shown in FIG. 4 while the parts of the deck 5 forming the connection between skirt 15 and deck 5 are made in accordance with the form of the skirt at deck level.

In accordance with the invention the positioning of the center of gravity of the container 6 above the deck is a function of the center of gravity for the displacement and consequently the metacenter height and thereby the stability. These conditions can make it possible to arrange the center of gravity of the container(s) at such a height above the deck that the bottom part of the containers will lie above deck level 5 so that the deck in this case forms the bottom of the frame 14 and the subjacent longitudinal bulkheads and transverse bulkheads are still the supporting elements. It will appear from the above that the sphere can be supported below the equator line, also substantially above this line, without the longitudinal bulkheads and transverse bulkheads having to form a frame with comparable reduced dimensions but can be dimensioned so that safe force transmittal to the subjacent bulkheads can be maintained.

The connection between container and skirt can be arranged in several ways known per se, e.g. as shown in Norwegian Published Application No. 124,472 where the skirt is welded to a reinforcement ring forming a part of the surface of the sphere and welded to the sphere near its equator. Another design is shown in U.S. Pat. No. 3,011,674 where re-inforced parts welded into the surface of the sphere, preferably in the equator area of the sphere, form brackets that rest on corresponding brackets welded to e.g. a skirt.

This so-called stiff connection between container and skirt has shown certain disadvantages, and a preferred design is an arrangement where the container to a larger degree can move independently of the skirt (not shown). During filling of cooled liquefied gas the container is subjected to a considerable contraction. As an example, an aluminum container with a diameter of about 18 meter by atmospheric temperature of 22° C will contract about 69 mm in diameter under filling of liquid oxygen. It is therefore desirable that this contraction does not subject the skirt and the subjacent hull structure to partly uncontrollable stresses to a larger degree than necessary.

A preferred solution is an arrangement where the container is supported by the skirt or directly on the frame/deck without a skirt in between by means able to absorb the mentioned contraction/extension forces in an elastic way, e.g. hydraulically, mechanically or similar, that is to say, the container can move freely and under control while subjected to the different forces.

As an example, hydraulic means can be arranged in a suitable number in suitable places around the container in such a way that the arrangement yields when compressive or tensile forces arise and subsequently move back to the initial position, the neutral position, as the tensile or compressive forces subside.

The further important part of the invention as compared to other known constructions for transportation of liquefied gas where the containers e.g. are surrounded by the hull is the substantial reduction in isolation material and aluminum or special steel to be installed in order to protect the hull against gas.

In accordance with the invention, gas leakage or gas introduced in other ways is collected in the frame 14 which has a small volume compared to the previously mentioned design. It is only the inner or outer sides of the frame 14 which in special cases must be insulated and, likewise, only the inner sides of the frame 14 that must be covered or clad with e.g. aluminum 5083, 9% nickel steel or other metals resistant to attack from gas, while all subjacent parts of the hull can be made of usual soft steel. The frame 14 can alternatively be made from the previously mentioned materials in its entirety.

The frame 14 forms a tight barrier against subjacent areas. In case the container contains materials or goods which do not attack ordinary ship steel in a detrimental way, the frame 14 can preferably be open against subjacent room without bottom part 19, and the frame 14 in these cases are made of the same material as the rest of the hull.

A further feature is the easily accessible area formed by the frame 14 having an upper open end formed to snugly receive container 6, side walls 21 and a bottom wall 19. The bottom wall of the frame 14 is preferably made inclined to one and/or the other side or corner, so that liquid leakage at all times freely can run from the bottom part 19 of the frame into an outlet 22 and through a common or separate pipe 23 to subjacent apparatus 24 for further treatment and possible return to other closed containers or, in case of an emergency be led directly from the frame 14 or pumped to open sea where the liquefied gases will quickly evaporate. Leading away leakage of liquefied gas directly overboard is known per se from U.S. Pat. No. 3,422,779, but here this takes place for any leakage without the possibility for collection of the liquefied gas and, since the deck of the ship is at or under the surface of the water, a non-return valve is necessary in the piping, while it is not necessary in the present invention.

The advantage of the elevated arrangement of the barrier, i.e. the frame 14 above the previously known system for transporting away liquid leakage from the bottom part of the ship, is obvious and makes possible a substantial simplification of the piping arrangement in addition to economic savings.

A further important feature of the invention is the system for emptying the containers. In the present example, the containers 6 are arranged in a row along the center line of the hull as shown in FIGS. 1 and 2 due to the large dimensions of the containers, but smaller containers can obviously be arranged side by side in rows without stability problems etc.

Emptying of the tanks, e.g. during unloading, preferably takes place by means of unloading pipes 28 arranged at the lowest point of the container, and the liquid can freely be led to subjacent equipment 26 for e.g. unloading. The pumping equipment can preferably be common to all the containers, and the liquid can, in accordance with the invention, be introduced into the pumps at a pressure equivalent to the liquid height above the pumps. This eliminates the usually complicated suction piping associated with other methods. In addition, the number of pipes is reduced to a minimum, i.e. a number preferably smaller than the number of containers, and this arrangement means considerable economic advantages over a usual method where the unloading pump is arranged submerged in each container.

In accordance with the invention, the maximum safety is assured in collision or similar accidents when transporting liquefied gas since the side tanks protect the containers from penetration by foreign ships, etc. In grounding the subjacent hull with center tanks and wing tanks likewise form a protection barrier for the container 5. For safety reasons, an inert gas system is arranged in the usual way in order to neutralize gas leakage from the containers. The containers are insulated by a covering 29 in the usual way in order to minimize evaporation of the liquefied gas. Also, the containers have the usual protective shell 7 made of galvanized steel plate, ship board or similarly installed at a certain distance from the container totally enclosing the container.

It will be apparent from the above that the hull of the vessel in the present example can be regarded as a usual tanker vessel without this being a restriction of the spirit of the invention which basic idea is to utilize the savings of weight gained by transportation of cargos with low specific gravity, e.g. cooled, liquefied methane which in volume requires 1/632 of the original volume, said savings of weight in the present example being made more effective by combining a vessel for transport of liquefied gas or LNG with a tanker in one and the same hull.

What is claimed is:

1. A vessel having an upper deck and having at least one container for the transportation of cooled, liquefied gas or the like, comprising: at least one center cargo hold located below the deck of the vessel; said center hold including interconnected longitudinal and transverse bulkheads and a support frame interconnected with said bulkheads and located at a top portion of said center hold, said bulkheads forming side walls of said frame and said support frame having an open top portion; and side tanks extending down from the deck and extending transversely outwardly of said center hold and said frame; said container being supported by said frame and the lower portion of said container extending downwardly within said open top portion of said frame.

2. The vessel according to claim 1, wherein said frame extends slightly above the level of said deck.

3. The vessel according to claim 1, wherein an outlet is provided at the lowest point of said container and a subjacent unloading unit including unloading pipes are connected to said outlet, said pipes being arranged entirely outside of said container.

4. The vessel according to claim 1, wherein said side tanks extend between an upper deck of the vessel and a bottom hull structure of the vessel, said side tanks being adapted to be utilized for the transporting of cargo from a first location to a second location for delivery of such cargo at such second location.

5. A vessel having an upper deck and having at least one container for the transportation of cooled, liquefied gas or the like, comprising: at least one center cargo hold located below the deck of the vessel; said center hold including interconnected longitudinal and transverse bulkheads and a support frame interconnected with said bulkheads and located at a top portion of said center hold, said support frame having an open top portion; a transition member located above said frame surrounding said container for supporting said container, said transition in the lower end being of a rectangular form corresponding to said frame and in the upper end being of a configuration corresponding to the form of the container; and side tanks extending down from the deck and extending transversely outwardly of said center hold and said frame; said container also being supported by said frame and the lower portion of said container extending downwardly within said open top portion of said frame.

6. A vessel having an upper deck and having at least one container for the transportation of cooled, liquefied gas or the like, comprising: at least one center cargo hold located below the deck of the vessel; said center hold including interconnected longitudinal and transverse bulkheads and a support frame interconnected with said bulkheads and located at a top portion of said center hold, said support frame having an open top portion; and side tanks extending down from the deck and extending transversely outwardly of said center hold and said frame; said container being supported by said frame and extending downwardly within said open top portion of said frame; said frame forming an enclosure beneath said container and said frame having an upper open end contoured to snugly receive said container, and side walls and a bottom wall interconnected with said side walls.

7. The vessel according to claim 6, wherein a fluid outlet is provided in said bottom wall of said frame, and said bottom wall having portions sloping downwardly toward said outlet so that any fluid leakage from said container will be directed toward said outlet.

8. The vessel according to claim 7, wherein a subjacent member is connected to said outlet at one end and is coupled at its other end to said container and to outside the vessel for respectively returning the fluid leakage back into said container and for directing it overboard.

* * * * *